US005333832A

United States Patent [19]

Bartholomew et al.

[11] Patent Number: 5,333,832

[45] Date of Patent: Aug. 2, 1994

[54] BLOWOUT PREVENTER WITH REMOVABLE PACKER

[76] Inventors: Leroy E. Bartholomew, 15130 Forest Lodge, Houston, Tex. 77070; Eric G. Childs, 1703 Breezy Bend, Katy, Tex. 77494; David M. Callahan, 22230 Prince George, Katy, Tex. 77449

[21] Appl. No.: 131,132

[22] Filed: Oct. 4, 1993

[51] Int. Cl.[5] ..... E21B 33/06

[52] U.S. Cl. ..... 251/1.3; 251/1.1

[58] Field of Search ..... 251/1.1, 1.3

[56] References Cited

U.S. PATENT DOCUMENTS 4,398,729 8/1983 Bishop et al. ..... 251/1.3 X

*Primary Examiner*—John C. Fox

[57] ABSTRACT

An improved ram-type blowout preventer having an improved resilient ram packer which includes an upper retainer plate and a lower retainer plate which each have a front face with a central recess therein, a back and sides, resilient end elements bonded between the plates at the sides and having facing surfaces extending from front to back and a resilient insert shaped to be positioned between said plates and between said end elements with sides mating with the shape of the facing surfaces of the end elements.

8 Claims, 4 Drawing Sheets

BLOWOUT PREVENTER WITH REMOVABLE PACKER

BACKGROUND

The present invention relates to an improved blowout preventer and particularly to an improved blowout preventer in which a portion of the packer which is subject to the most wear may be easily and quickly replaced.

Prior to the present invention blowout preventers have long had rams which carried a packing element on their front face which is adapted to seal against both the face of the opposite packer and around a string positioned in the recesses of the opposed packers.

U.S. Pat. No. 4,541,639 discloses a ram-type blowout preventer with a ram front packer which is replaceable. In one form of this prior patent, the replaceable portion of the ram front packer extends completely across the front of the packer and in another form the replacement form of the packer extends immediately around the pipe engaging recess of the packer. In both forms the packer and the insert have interengaging elements which retain the insert in the front face of the packer. The insert element of both forms included both upper and lower retaining plates having the same shape as the insert and bonded thereto so that the complete assembly could be removed and a new insert inserted into the main body of the packer.

SUMMARY

The present invention provides an improved ram-type blowout preventer with an improved ram front packer which has an insert which can be withdrawn from between the upper and lower retaining plates at the rear of the packer and replaced in a similar manner and which does not require the interengaging element of the insert and main packer body.

An object of the present invention is to provide an improved ram-type blowout preventer having a ram front packer with a readily replaceable insert which is not bonded to the packer retaining plates.

Another object of the present invention is to provide an improved ram front packer for a ram-type blowout preventer which is less expensive than the prior devices and which functions as well or better than such devices.

A further object of the prevent invention is to provide an improved ram front packer for a ram-type blowout preventer in which the wear portion of the resilient packer material may be replaced without having to replace the retainer plates of the packer.

BRIEF DESCRIPTION OF THE DRAWINGS

These and other objects of the present invention are hereinafter set forth and explained with reference to the drawings wherein.

DESCRIPTION OF THE PREFERRED EMBODIMENT

Figure 1:
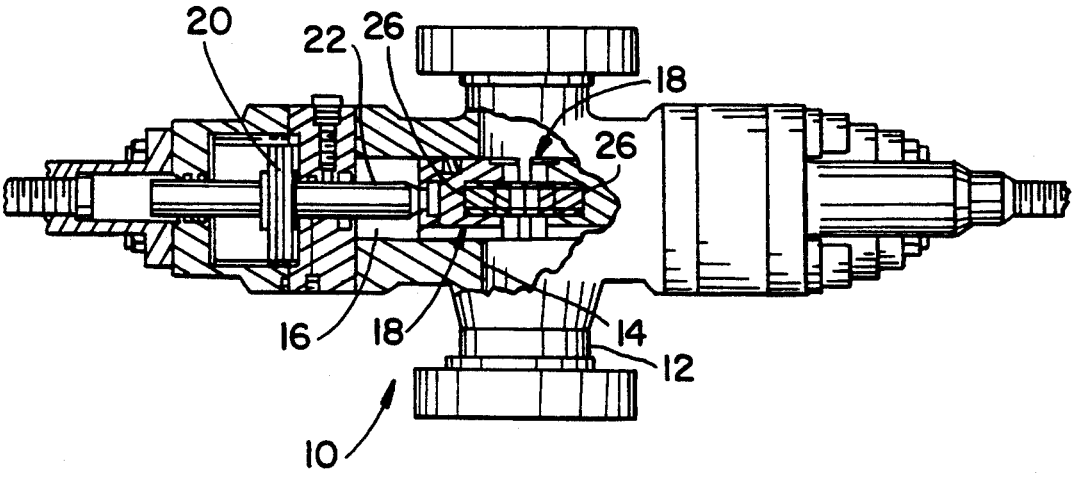
FIG. 1 is an elevation view of a ram-type blowout preventer of the present invention with a portion thereof taken in section to illustrate internal portions such as the rams, the pistons and the ram front packers.
Figure 2:
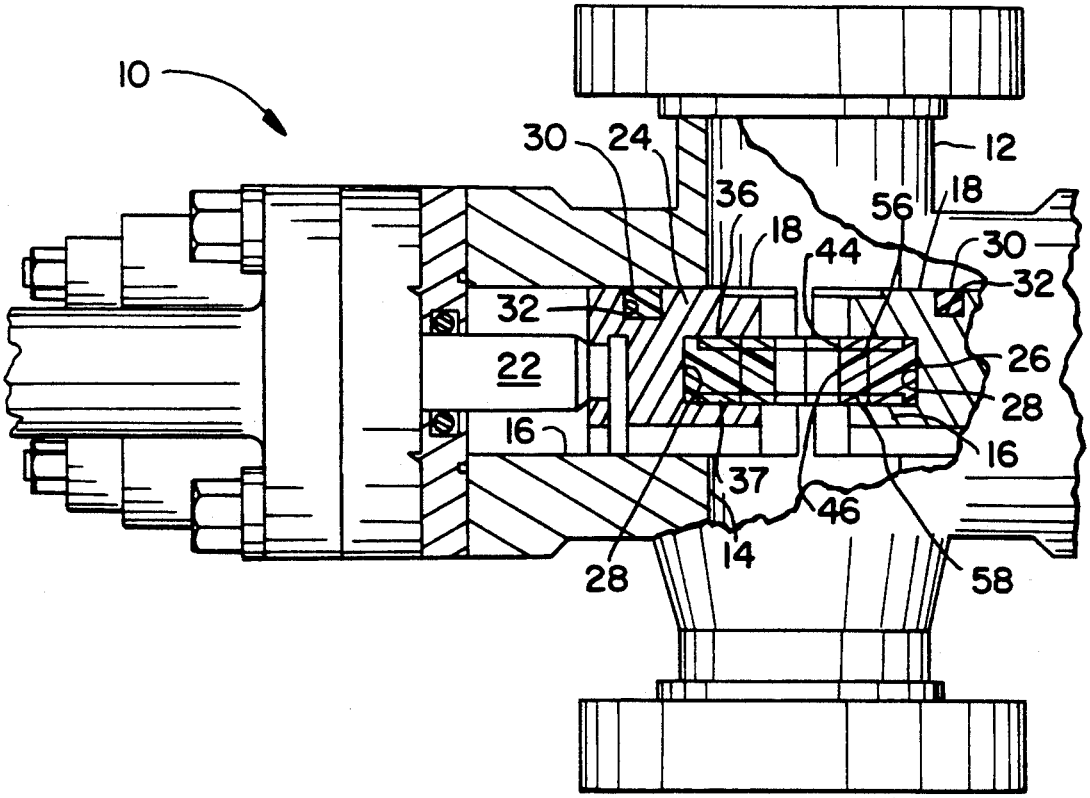
FIG. 2 is an enlarged view of the blowout preventer of FIG. 1 showing the improved ram front packers of the present invention.

Blowout preventer 10 as shown in FIGS. 1 and 2, includes body 12 through which central bore 14 extends with opposed aligned guideways 16 extending outward from bore 14. Ram 18 is moved in guideway 16 by suitable actuator 20 connected to ram 18 by connecting rod 22. Ram 18 includes body 24, ram front packer 26 positioned in front recess 28 of body 24 and packing seal 30, which is positioned in a groove 32 in body 24 that extends along the sides and across the top of body 24 and seal 30 seals against ram front packing 26 and against the interior of guideway 16.

Figure 3:
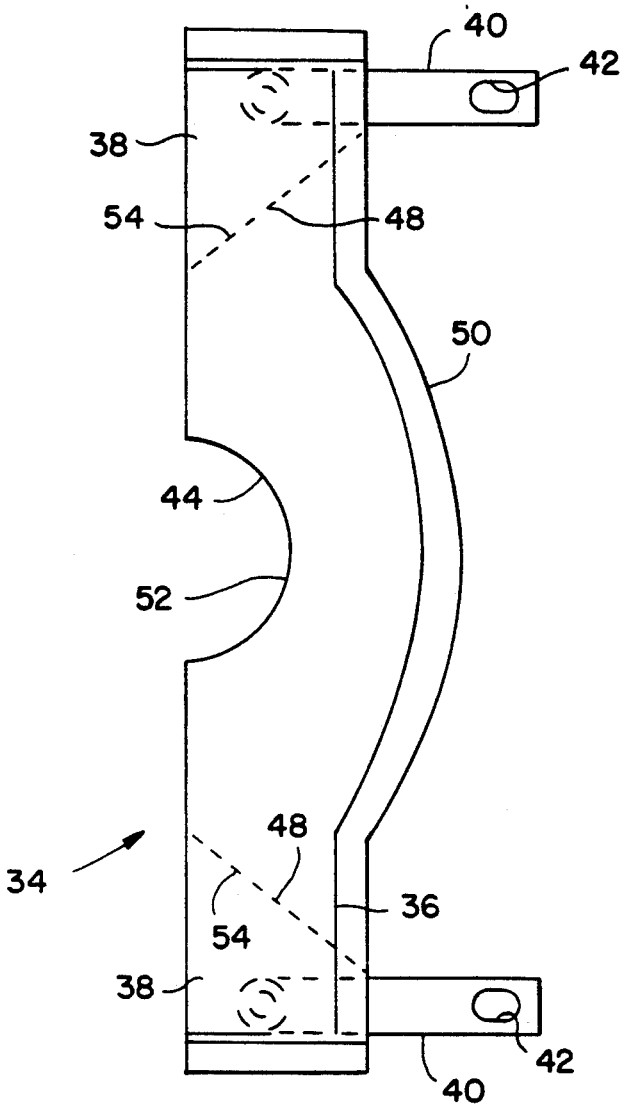
FIG. 3 is a plan view of one form of the improved ram front packer of the present invention.
Figure 4:
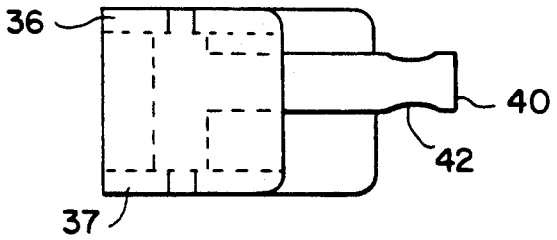
FIG. 4 is an end view of the packer shown in FIG. 3.
Figure 5:
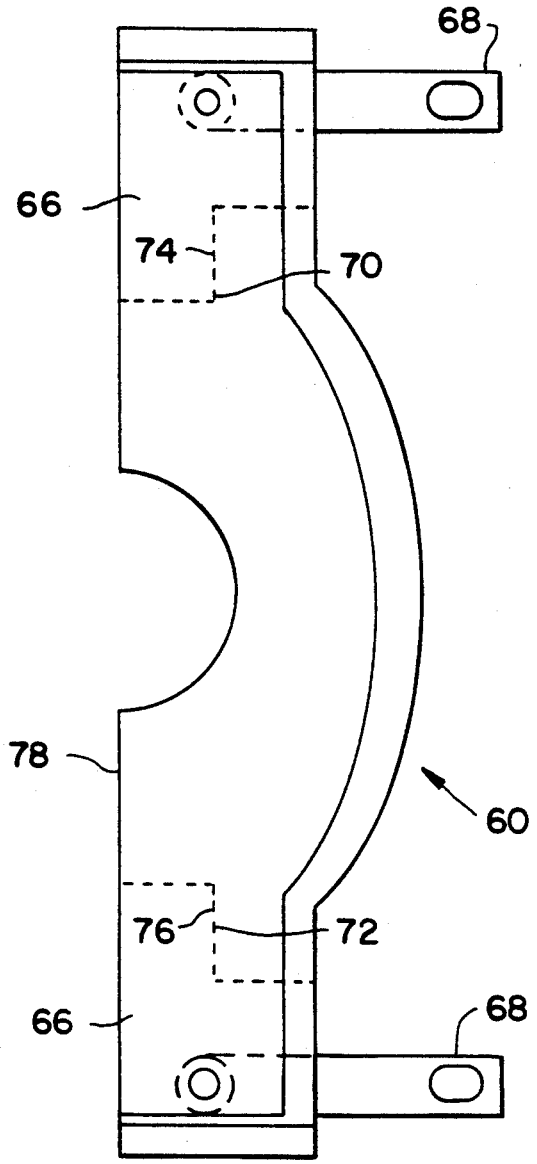
FIG. 5 is a plan view of another form of the improved ram front packer of the present invention.
Figure 6:
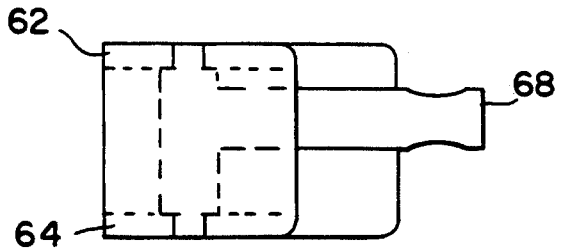
FIG. 6 is an end view of the packer shown in FIG. 5.

In the form of packer 26 illustrated in FIGS. 3 and 4 and designated packer 34, it includes upper and lower retainer plates 36 and 37 which are bonded to end packer elements 38 with T-shaped pins 40 molded therein and extending to the rear for connection to ram body 24 by the extension pins (not shown) on each side of packing seal 30 which extend through body 24 and engage within openings 42 of pins 40. Retainer plates 36 and 37 are substantially flat and have a front surface which is flat with a concave recess 44 in the center thereof forming the upper and lower part of the packer recess 46 in which a tubular member (not shown) extending through blowout preventer bore 14 would be received. The inner portions of end elements 38 have a tapered surface 48 which tapers to the rear and to the side as shown. Insert 50 has a shape which includes a front recess 52 and side tapered surfaces 54 which engage and mate with tapered surfaces 48. The upper and lower surfaces 56 and 58 have the complementary shape which mates with the inner surfaces of upper retainer plate 36 and lower retainer plate 37 as hereinafter described. When packer 34 is in use and is closed on a tubular member and against its opposed packer, the engagement between surfaces 48 on end elements and surfaces 54 will provide a seal to prevent leakage of fluids under pressure through the packer.

Packer 60 is a modified form of packer and includes upper and lower retainer plates 62 and 64 with end elements 66 bonded thereto and having t-shaped pins 68 molded therein for securing packer 60 within the front face recess 28 of ram body 24. End elements include inner sides which are stepped as at 70 and 72 to provide shoulders against which the mating stepped surfaces 74 and 76 of insert 78 engage and seal when the packer is in use. Packer insert 78 is sized to exactly fit between plates 62 and 64 and between end elements 66 to provide the front face of packer with the desired recess therein for the operation of the blowout preventer.

Figure 7:
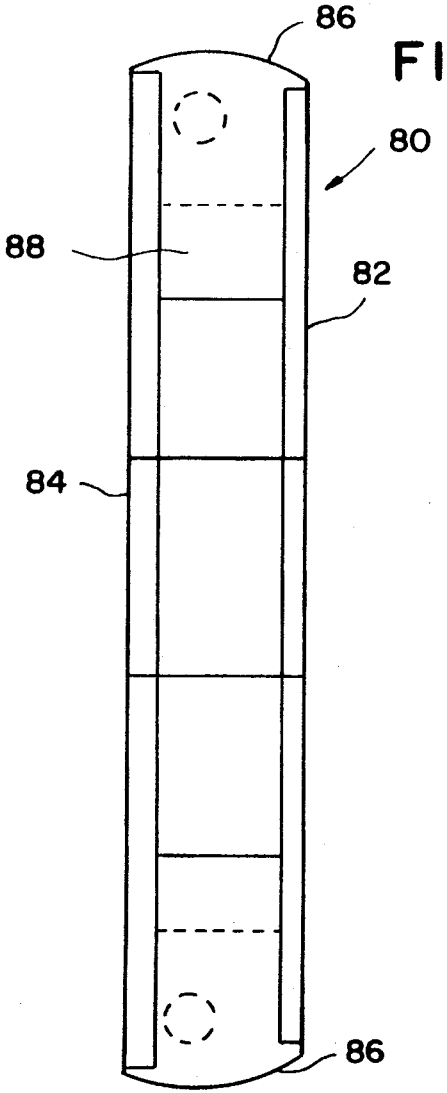
FIG. 7 is a front view of the packer shown in FIGS. 5 and 6 to show the flat shape of the retainer plates.

Packer 80, as shown in FIG. 7, includes upper and lower retainer plates 82 and 84 with end elements 86 bonded thereto and with insert 88 positioned between the plates 82 and 84 and between the two end elements 86 as previously described.

Figure 8:
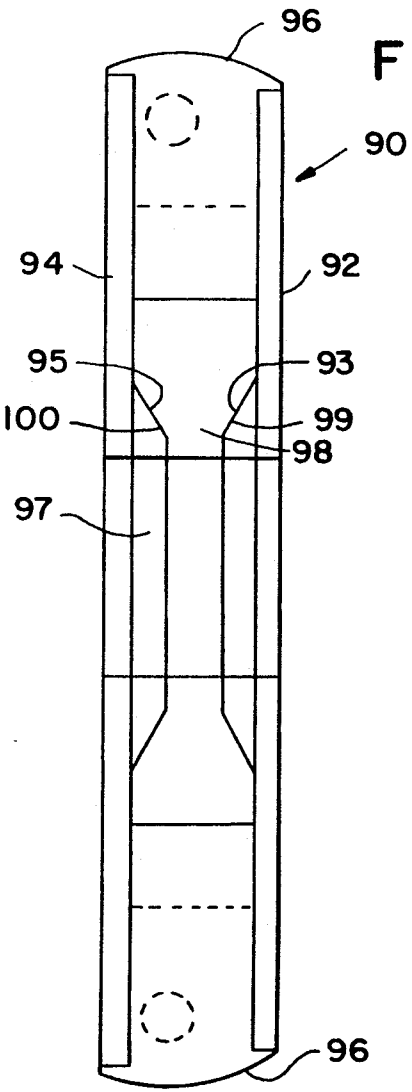
FIG. 8 is another front view of a modified form of improved packer having retainer plates which provide a restriction to the front face of the packer.

As seen in FIG. 8, packer 90 includes retainer plates 92 and 94 with end elements 96 bonded thereto and with insert 98 positioned between plates 92 and 94 and between the two end elements 96. Plates 92 and 94 have tapered surfaces 93 and 95 which may be integral with plates 92 and 94 or provided by wedges molded into packer insert 98. These tapered surfaces 93 and 95 restrict the opening around the front face recess 97 and the face of packer 90 immediately adjacent thereto. With this configuration of plates 92 and 94, packer insert 98 is also provided with upper and lower surfaces 99 and 100 which mate with and tightly engage tapered surfaces 93 and 95 of plates 92 and 94 as illustrated in FIG. 8.

What is claimed is:

1. A ram-type blowout preventer comprising a body with a vertical bore therethrough and opposed guideways extending radially away from said bore, a ram in each of said guideways, means for moving each of said rams in said guideways between a position closing said bore and a position withdrawn into said guideways with said bore open, each of said rams having a front face recess, a resilient packer in said front face recess of each of said rams, said resilient packer having upper and lower retainer plates having a front face and sides, resilient end elements bonded between said plates and having facing side surfaces extending from the front face of said packer to the rear of said packer adjacent said ram recess, a resilient insert having a shape mating with the facing sides surfaces of said end elements and sized to be received between said plates, and means for securing said resilient packer within the front face of its ram.

2. A ram-type blowout preventer according to claim 1 wherein the mating side surfaces of said end elements and said insert are tapered in a direction toward the sides of said packer in extending from the front of the packer toward the rear of said packer.

3. A ram-type blowout preventer according to claim 1 wherein the mating sides surfaces of said end elements and said insert are stepped.

4. An improved ram front packer for use in the front face of a ram in a ram-type blowout preventer comprising upper and lower retainer plates, each having a front face with a central recess, outer sides and backs, end elements bonded between said plates at positions between the plates at their outer sides, said end elements being resilient and having inner facing surfaces, a resilient insert shaped to be positioned between said plates and between said inner facing surfaces of said end elements and having side surfaces mating and engaging with inner facing surfaces of said end elements, and means for securing said packer into its desired position in the front recess in a ram.

5. An improved ram front packer according to claim 4 wherein said inner facing surfaces of said end elements taper outwardly toward the rear of said packer, and said insert side surfaces having a mating taper for engagement with the inner facing surfaces of said end elements.

6. An improved ram front packer according to claim 4 wherein said inner facing surfaces of said end elements and said mating side surfaces of said insert are stepped.

7. An improved ram front packer according to claim 4 wherein said plates each have an inner tapering projection adjacent the central portion of the front face central recess.

8. An improved ram front packer according to claim 4 including upper and lower arcuate elements embedded in said resilient insert having tapering surfaces for restricting the front face of said insert in said central recess.

* * * * *